United States Patent [19]

Yoke

[11] 4,410,316

[45] Oct. 18, 1983

[54] METHOD FOR PRODUCTION OF CORRUGATED PAPER

[76] Inventor: James H. Yoke, Rte. 15, Box 395, Acton, Ind. 46259

[21] Appl. No.: 359,368

[22] Filed: Mar. 18, 1982

[51] Int. Cl.[3] ..... B65H 45/22

[52] U.S. Cl. ..... 493/399; 493/403; 493/447; 493/456

[58] Field of Search ..... 493/59, 60, 160, 228, 493/240, 448, 396–404, 451, 461, 455–456, 463, 359, 69, 71, 72, 447–448; 83/884–886

[56] References Cited

U.S. PATENT DOCUMENTS

| | | | |
|---|---|---|---|
| 999,909 | 8/1911 | Taylor | 493/396 X |
| 1,896,037 | 1/1933 | Boeye . | |
| 1,975,548 | 10/1934 | Ives . | |
| 2,039,335 | 5/1936 | Nall | 493/399 |
| 2,046,985 | 7/1936 | Wilkins | 493/397 X |
| 2,257,428 | 9/1941 | Ruegenberg . | |
| 2,276,737 | 3/1942 | Plewes . | |
| 2,314,757 | 3/1943 | Benedict | 493/399 X |
| 2,901,951 | 9/1959 | Hochfeld . | |
| 2,974,716 | 3/1961 | Fourness . | |
| 3,038,718 | 6/1962 | Balsam | 493/448 X |
| 3,646,418 | 2/1972 | Sterns | 83/885 X |

*Primary Examiner*—A. J. Heinz

*Attorney, Agent, or Firm*—Woodard, Weikart, Emhardt & Naughton

[57] ABSTRACT

A method for the production of corrugated paper comprising the steps of feeding a continuous sheet of paper over a first arcuate roller, making several folds in the paper along lines of radius of the first arcuate roller, passing the paper over a second arcuate roller which has the same center of curvature as the first arcuate roller, and unfolding the paper folds to yield the corrugated paper. The paper preferably turns about 90° in passing over the first and second arcuate rollers, and after being unfolded there is provided additional corrugations by use of crimping rollers or the like.

7 Claims, 9 Drawing Figures

METHOD FOR PRODUCTION OF CORRUGATED PAPER

BACKGROUND OF THE INVENTION

1. Field of the Invention

The present invention relates to a method for the production of corrugated paper, and more particularly to a method which corrugates the paper with longitudinal ridges and grooves, rather than transverse corrugations.

2. Description of the Prior Art

Various methods and equipment have been proposed in the prior art for the production of corrugated paper. In U.S. Pat. No. 2,257,428, issued to Ruegenberg on Sept. 30, 1941, there is described a method and apparatus for making folds for crinkles in paper. The Ruegenberg method is described as useful with an all-around extensible and elastic paper or production of crepe paper or the like. This patent describes the use of a series of straight rollers positioned in parallel to make increasing depth to the folds.

A similar process and machine are described in U.S. Pat. No. 2,901,951, issued to Hochfeld on Sept. 1, 1959. The Hochfeld patent also describes the use of a series of parallel, straight line rollers which give increasing depth to the paper folds. In both the Ruegenberg and Hochfeld patents, it is significant that the use of the straight line rollers requires that the paper take different length paths depending on its location relative the rollers. This is one difficulty in the prior art which is overcome by the present invention.

In U.S. Pat. Nos. 2,276,737, issued to Plewes et al. on Mar. 17, 1942 and 1,975,548, issued to Ives on Oct. 2, 1934, there are described methods and devices for crimping and fluting paper at an angle to the direction of travel of the paper. Typical devices for crimping paper transverse of its direction of travel are disclosed in U.S. Pat. Nos. 1,896,037, issued to Boeye on Jan. 31, 1933 and 2,974,716, issued to Fourness on Mar. 14, 1961.

SUMMARY OF THE INVENTION

Briefly described in one aspect of the present invention there is provided a method for producing corrugated paper which includes feeding the paper over a first, arcuate roller such that the paper leaves the arcuate roller in the plane of the roller, making several longitudinal folds in the paper, passing the folded paper over a second arcuate roller, the second arcuate roller having about the same center of curvature as the first arcuate roller, and unfolding the paper to yield the corrugations.

It is an object of the present invention to provide a method for the production of corrugated paper.

Another object of the present invention is to provide a method for corrugating paper to yield uniform and well shaped corrugations.

It is a further object of the present invention to provide a method for producing corrugated paper with the ridges and grooves of the corrugation extending parallel to the direction of travel of the paper, rather than transverse to that direction.

A further object of the present invention is to provide a method for corrugating paper to accurately control the shape and position of corrugations, reduce the amount of paper and glue used, and increase the structural strength of the ultimate paper.

Another object of the present invention is to provide an apparatus for the production of corrugated paper, and particularly one which meets the above purposes.

Further objects and advantages of the present invention will become apparent from the description of the preferred embodiment which follows.

DESCRIPTION OF THE PREFERRED EMBODIMENT

Figure 1:
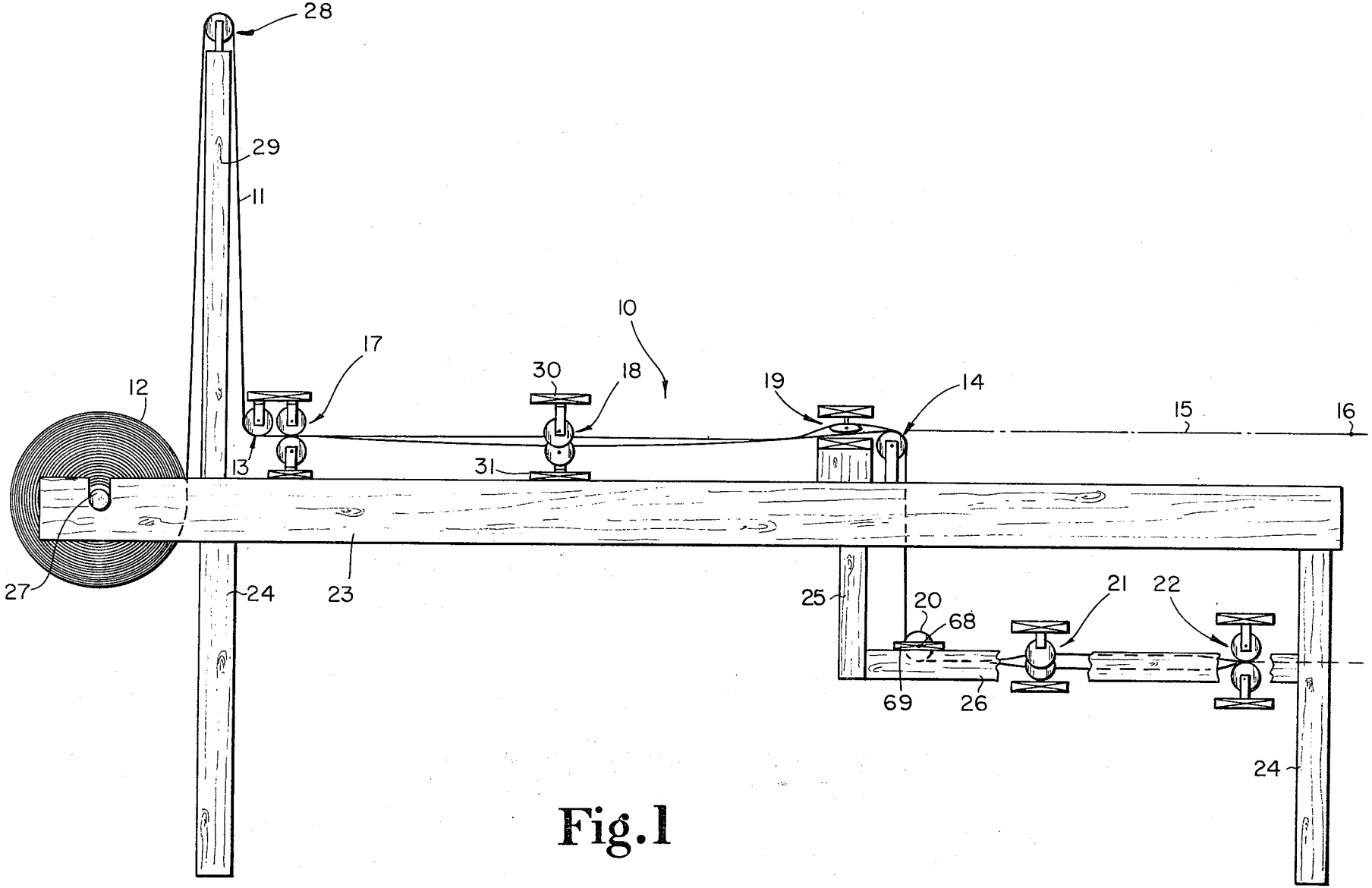
FIG. 1 is a side, partially schematic drawing of an apparatus for producing corrugated paper in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Before proceeding with the detailed description of the present invention, a general summary of the process will be provided. Referring in particular to FIG. 1, there is show a paper corrugator 10 constructed in accordance with and useful in the present invention. As is customary, the apparatus utilizes a continuous sheet of paper 11 received for example from a roll 12. The apparatus 10 includes a first arcuate roller 13 and a second arcuate roller 14. The two arcuate rollers lie in about the same plane 15 and have a common center of curvature 16 lying in that plane. The paper 11 is passed over the first arcuate roller 13 to move from that roller in about the plane 15. Successive folding members 17–19 provide longitudinal ridges and grooves in the paper 11 and then fold the paper over for passage over the second arcuate roller 14. The paper moves to the roller 14 in the plane 15, and then passes from the roller at about a 90° angle from the plane 15. In the preferred embodiment, the paper then passes over a straight roller 20 to again change direction by about 90°, the folds are separated by the members 21 and crimping rollers 22 provide additional corrugations.

A particular embodiment of the paper corrugator 10 is shown in FIG. 1. In this embodiment, a main frame 23 is supported on legs 24 and in turn supports through an arm 25 a subframe 26. The paper roll 12 is received on a suitable axle 27 which is in turn received by the frame 23 for rotation. Alternatively, the axle 27 is fixed to the frame 23 and the roll is permitted to rotate about the axle. The paper passes upwardly over a directional roller 28 supported by upstanding arms 29. In this fashion, the paper moves vertically downward to the first arcuate roller 13 and thereafter passes horizontally in the plane 15 of the arcuate rollers.

As will be described in detail with respect to the later drawings, the various folding and unfolding members, such as folding discs 18, are provided in pairs mounted upon suitable supports, such as 30 and 31. Typically, one set of the discs is positioned above the paper and the other set is positioned below the paper, thus providing for the desired folding or shaping of the paper as it passes therebetween.

Also as shown in FIG. 1, the paper passes vertically downward from the second arcuate roller 14 to a straight, directional roller 20, from which it passes in the horizontal plane. It will however be appreciated that the orientation of the rollers and paper is not fixed, but may be modified as desired. It has been found to be desirable to have the arcuate rollers 13 and 14 in a horizontal plane, and thus the directional roller 28 is useful to direct the paper to the first arcuate roller in the proper direction. It will also be appreciated that the invention is described herein as including paper which passes at about 90° angles to or from the arcuate rollers. It will be appreciated that this angle is variable, particularly depending upon the size and nature of the paper being used.

In accordance with the present invention, the first step is in feeding the continuous sheet of paper 11 over a first arcuate roller 13. The paper is fed to the first arcuate roller preferably at an angle about 90° to the plane 15 of the first arcuate roller. The paper passes from the first arcuate roller 13 in about the plane 15. The next step is to make several longitudinal folds in the paper as it moves in the plane 15 to the second arcuate roller 14.

Figure 2:
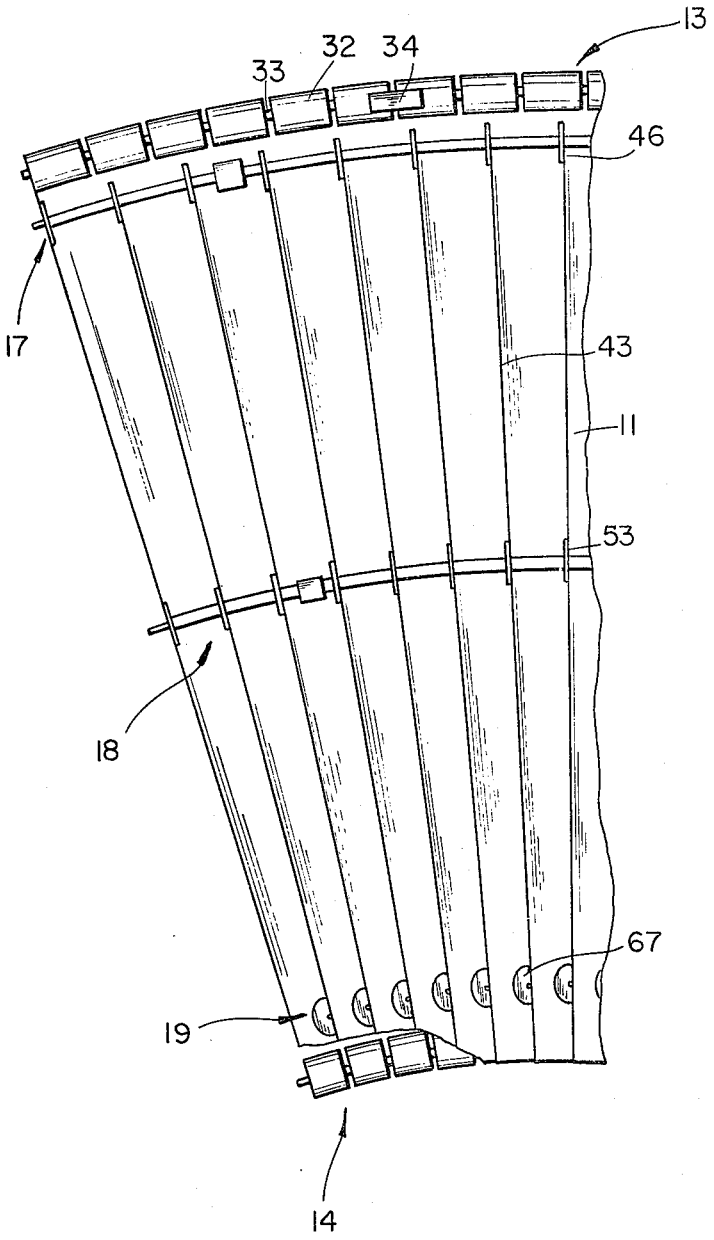
FIG. 2 is a top, plan view of a portion of the apparatus of FIG. 1, and particularly showing the two arcuate rollers
Figure 3:
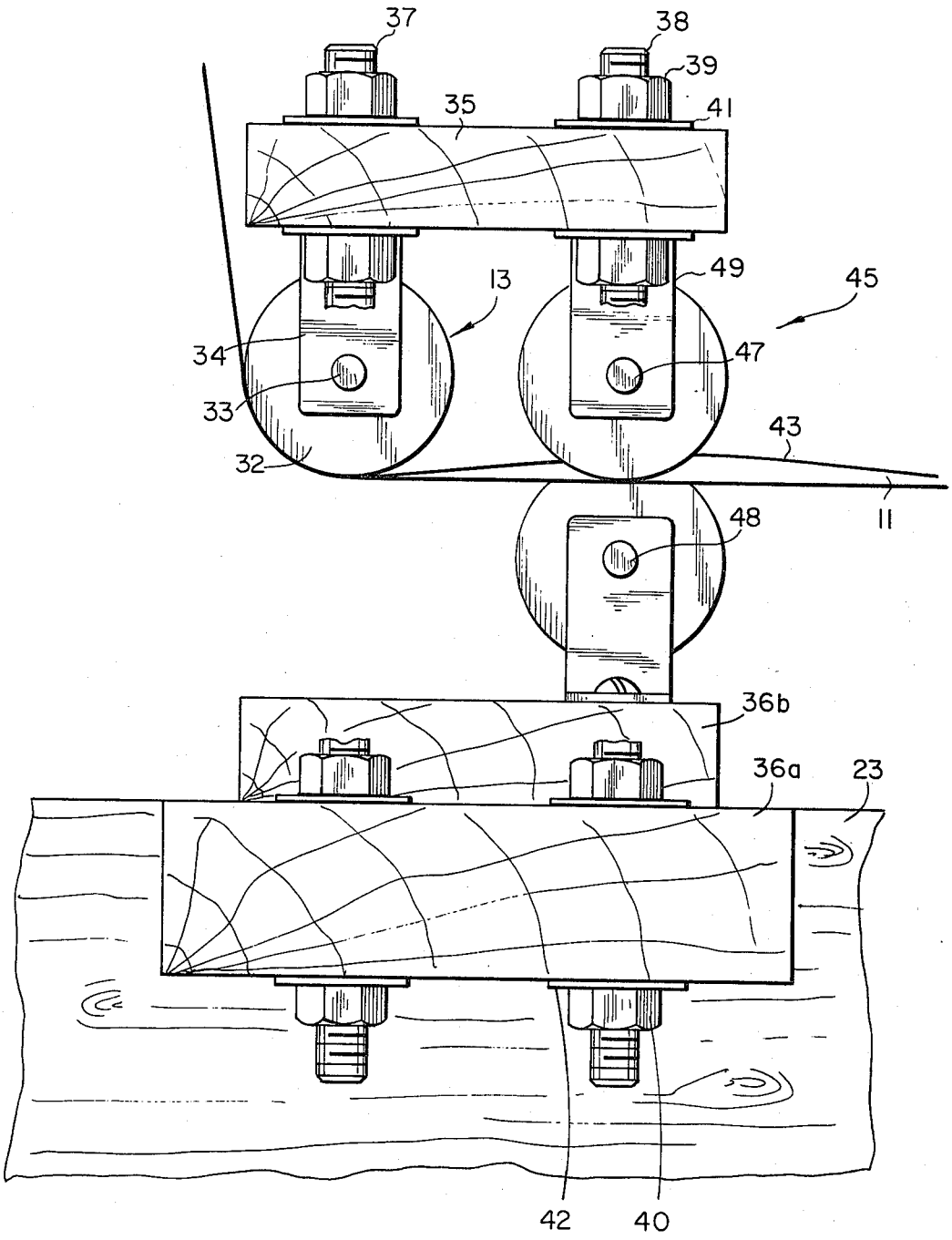
FIG. 3 is a side, elevational view of the first arcuate roller useful in the present invention.

Referring in particular to FIG. 2, this first section of the apparatus 11 is shown from a top view. The first arcuate roller 13 includes several cylindrical rollers 32 received upon a shaft 33. The shaft has an arcuate configuration, and is supported by several brackets 34 mounted to an upper support member 35. The upper support member 35 is secured to a lower support member 36A which is in turn attached to the frame 23. On each side of the apparatus there is included a pair of threaded rods 37 and 38 which extend through aligned apertures in the support members 35 and 36A. As shown in FIG. 3, nuts such as 39 and 40 and washers such as 41 and 42 are received upon the rods 37 and 38 on opposite sides of the upper and lower support members to provide for positioning of the support members. In this fashion, the distance between the upper and lower support members may be varied as desired, depending upon the operating characteristics which are required for the apparatus.

Figure 4:
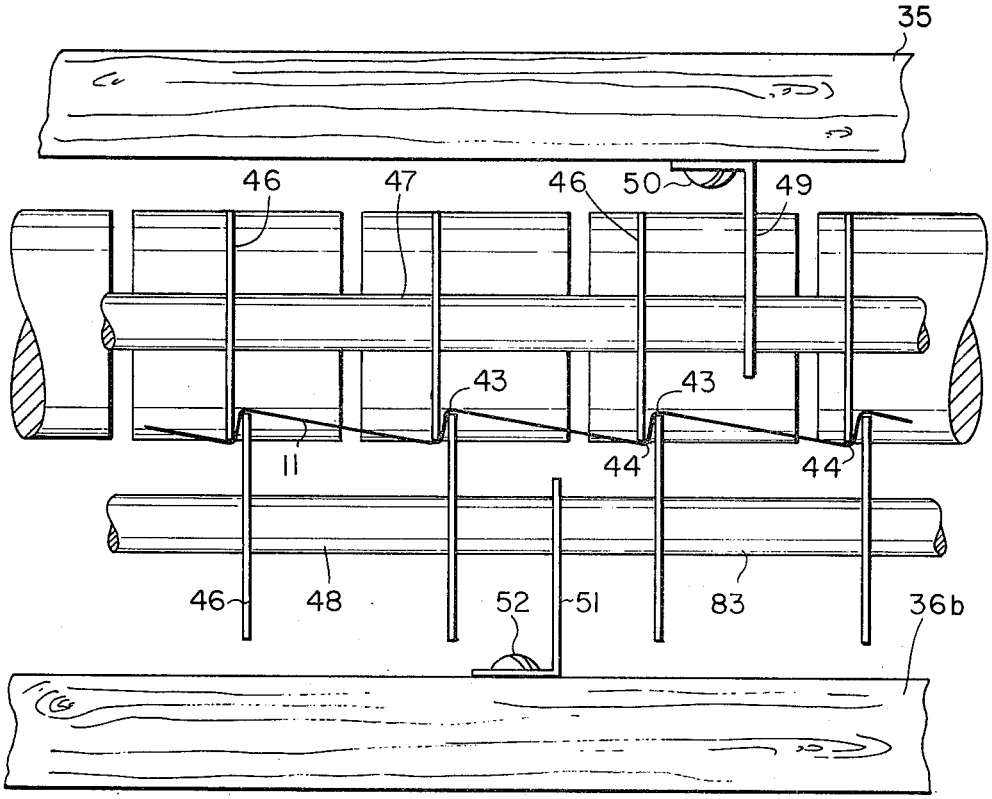
FIG. 4 is a front view of a portion of the first arcuate roller and associated row of folding discs.

As discussed, there are several longitudinal folds made in the paper as it passes from the first arcuate roller 13 to the second arcuate roller 14. These folds are prepared by first forming several longitudinal and parallel ridges 43 and grooves 44. A first set of folding members 45 are provided adjacent the first arcuate roller 13. As shown particularly in FIGS. 3 and 4, the first folding members comprise several folding discs 46 received on parallel curved shafts 47 and 48. The shaft 47 is mounted to the upper support member 35 by means of a bracket 49 attached to the upper support member by means of a screw 50. Similarly, the lower shaft 48 is secured to the lower support member 36B by means of a bracket 51 secured by a screw 52. As shown in FIG. 4, the folding discs 46 are positioned on the respective shafts to provide a beginning shaping of the paper 11.

It is desired to provide the ridges and grooves at equal but alternating spacings so that the material eventually can be laid over upon itself to reduce its width by a certain amount, such as by one-half. It will be appreciated that if the ridges and grooves were equally spaced along the width of the paper, then any folding of the paper would result in reducing the paper down to a very small size, particularly the width of the spacings of the ridges and grooves. Alternatively, only certain ones of the folds could be used if a greater width of the paper was desired. To avoid these two alternatives, the present invention positions the ridges and grooves at spacings such that each of the ridges can be folded over on the adjacent paper to reduce the width of the paper by only a desired amount, such as one-half.

Thus as shown in FIG. 4, it is desirable in the preferred embodiment to locate the discs 46 on the respective shafts 47 and 48 such that the distance from a particular ridge to the groove on one side is relatively short and to the groove on the other side is relatively long. In forming these creases or folds in the paper, the discs 46 are used and they preferably are rotatable about the shafts such that they will rotate with the paper as it is moved therebetween. To position the discs and to provide for such rotation, there is preferably included a series of spacers 83 which are cylindrical and are received over the shafts 47 and 48 between each successive pair of discs to maintain their location as desired.

As previously noted, the shafts 47 and 48 are mounted to the upper and lower support members 35 and 36B. As previously indicated, the position of the upper support member 35 is variable with respect to the frame 23. The lower support member 36B which carries the lower disc shaft 48 is mounted to the frame 23. Thus, the relative spacing between the shafts 47 and 48, and the discs carried thereon, may be varied by appropriate adjustment of the upper support member 35.

Figure 5:
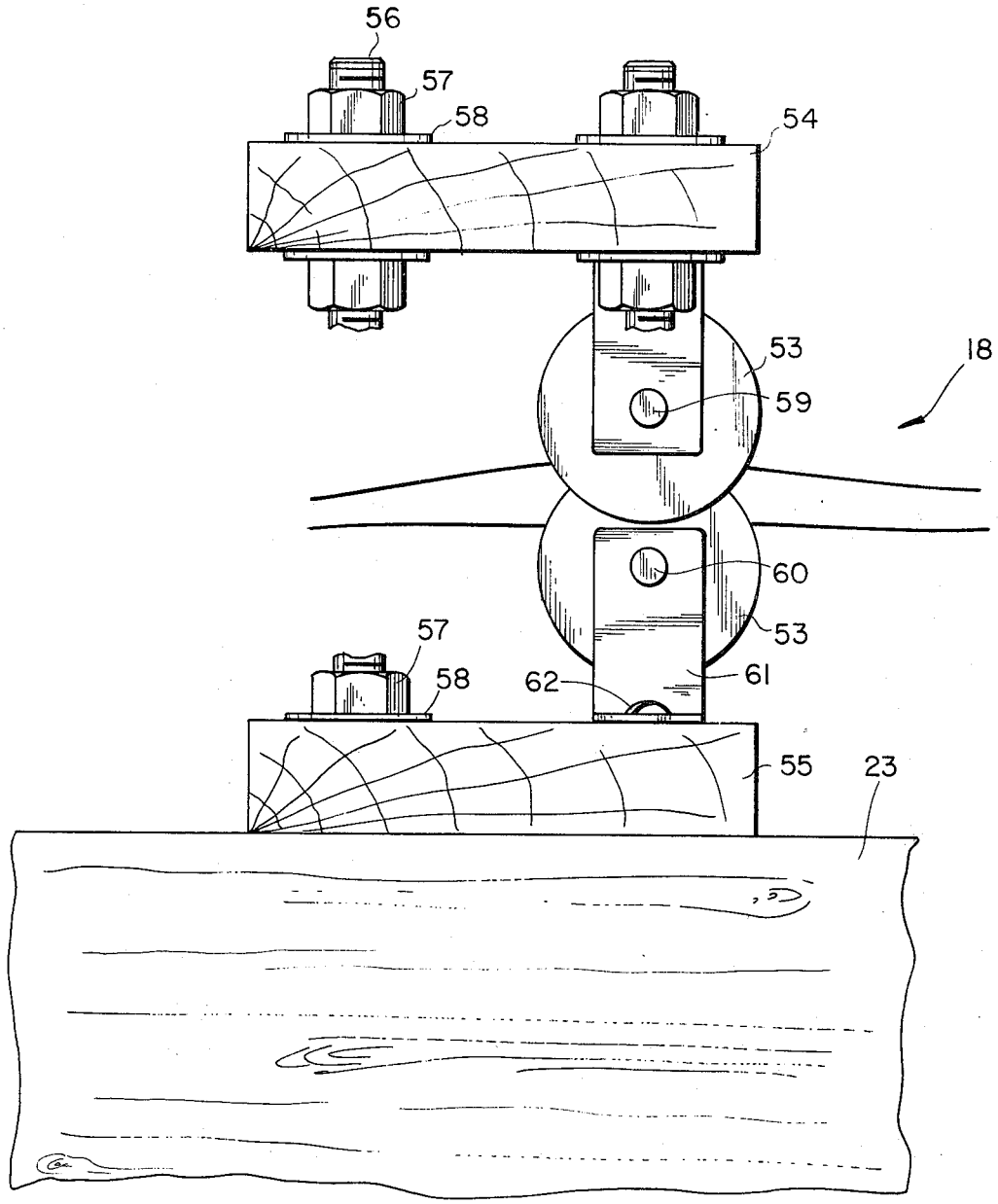
FIG. 5 is a side, elevational view of a second row of folding discs.
Figure 6:
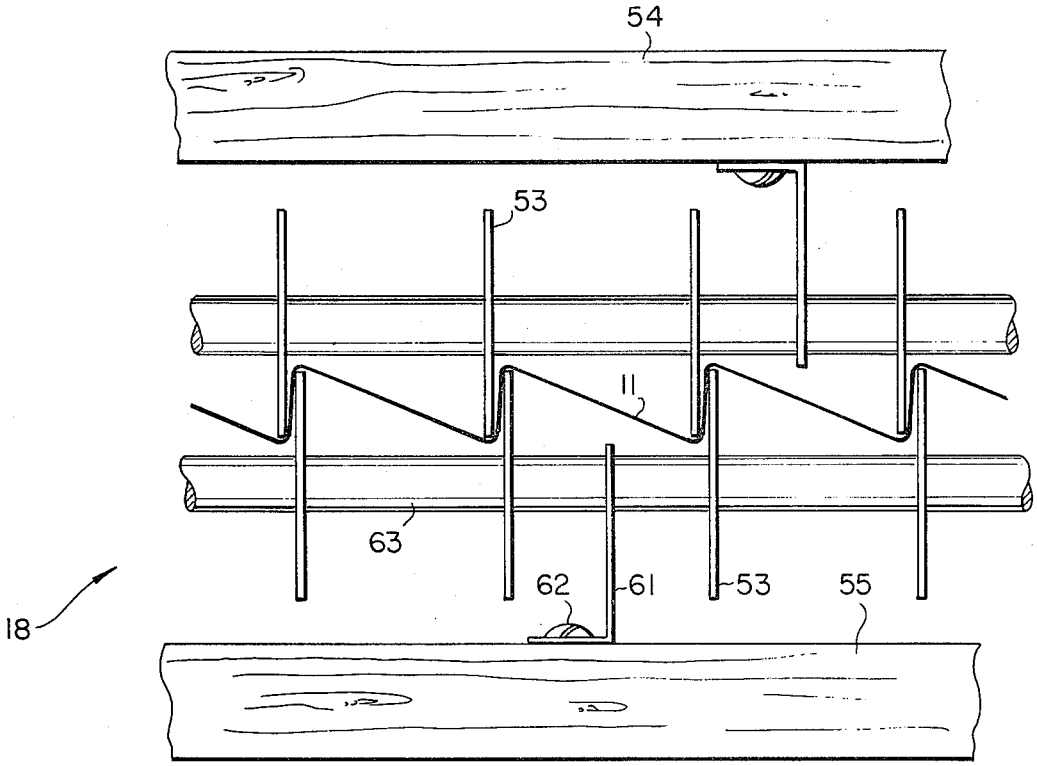
FIG. 6 is a front, elevational view of a portion of the second set of folding discs.

Referring to FIGS. 5 and 6, there is shown a second set of folding members 18, which again preferably comprise folding discs such as 53. The folding members 18 are constructed almost identically with the folding members 17 shown earlier. Upper support members 54 are mounted to lower support members 55 which in turn are secured to the frame 23. The upper support member is mounted by means of rods, such as 56, mounted with nuts 57 and washers 58 in the same manner as previously described to provide for vertical adjustment of the upper support member. The folding discs 53 are mounted on shafts 59 and 60 which are in turn mounted to the respective support members such as by brackets 61 and screws 62. Spacing sleeves 63 are included on the respective shafts between associated discs to provide for proper spacing of the discs and rotation thereof. As shown in FIG. 6, particularly in comparison with FIG. 4, it is apparent that the function of the second folding members 18 is to provide a further depth of fold in the paper 11.

Figure 7:
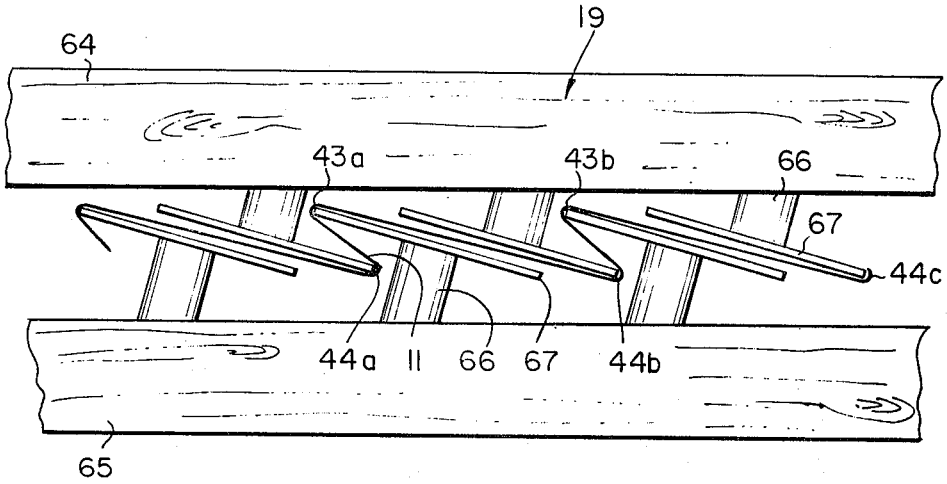
FIG. 7 is a front, elevational view of a portion of the third set of folding discs.
Figure 8:
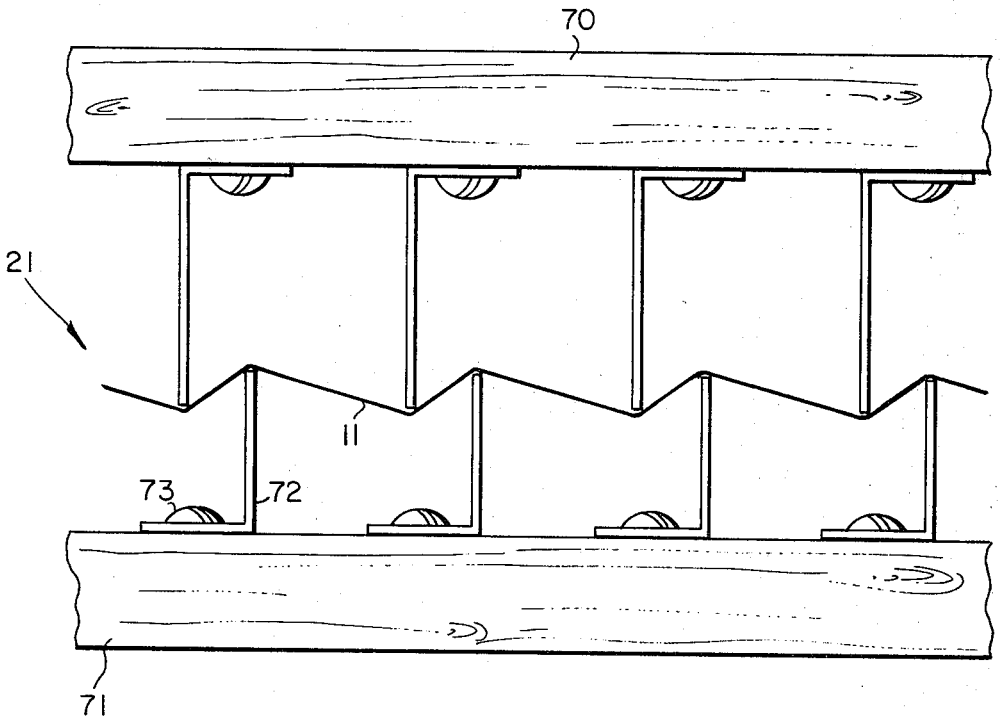
FIG. 8 is a front, elevational view of a portion of the sliding tabs used to unfold the folded paper after passing over the second arcuate roller.

In FIG. 7 there is shown the third set of folding discs 19. A pair of support members 64 and 65 are secured to the frame 23 in the fashion, for example, as previously described. Attached to the support members are several mounting members 66 to which are rotatably attached the folding discs 67. These folding discs 67 provide for positioning the paper in the folded over condition prior to passage over the second arcuate roller 14. As previously described, the folds are made such that the spaces between ridges and grooves are equal alternating distances. In other words, referring in particular to FIG. 7 it is shown that the distance from ridge 43A to groove 44A is the same distance as from the ridge 43B to groove 44B. At the same time, the distance from ridge 43A to groove 44B is about the same distance as from ridge 43B to groove 44C. However, the distance for example from ridge 43A to groove 44A is substantially shorter than the distance from ridge 43A to groove 44B. In this fashion, the paper may be folded over in the manner indicated in FIG. 7 to yield a flat sheet of paper having the several folds shown.

Referring in particular to FIG. 2, it is shown that the various folding members 17–19 are configured and oriented in a fashion to make the respective ridges and grooves pass generally along radial lines from the center of curvature of the arcuate rollers 13 and 14. In this fashion, the ridges and grooves, and more generally the various portions of the paper 11 are caused to move along paths of identical length from the first arcuate roller to the second arcuate roller. Unlike the prior art, this achieves a folding of the paper without causing binding or other undesirable stresses on the paper due to different portions of the paper travelling different distances. It will also be appreciated that various types of rollers and folding members may be used in performing this invention. In the preferred embodiment, however, the arcuate rollers comprise several cylindrical rollers on an arcuate shaft, and the folding members are rotating discs as described.

As shown in FIG. 1, the paper passes over the second arcuate roller 14 and then vertically downward to a straight, directional roller 20. As shown, the straight roller 20 is mounted through a shaft 68 to a support member 69, which is in turn secured to the sub-frame 26.

From the straight roller 20 the paper passes through unfolding members 21. Support members 70 and 71 are mounted to the sub-frame 26 in the same fashion as previously described. Although folding discs could be used as in the earlier description, the unfolding members may suitably comprise sliding tabs 72 secured by screws 73 to the respective support members. These tabs are positioned to simply raise the folds such that the paper can be delivered in the unfolded, corrugated condition.

Figure 9:
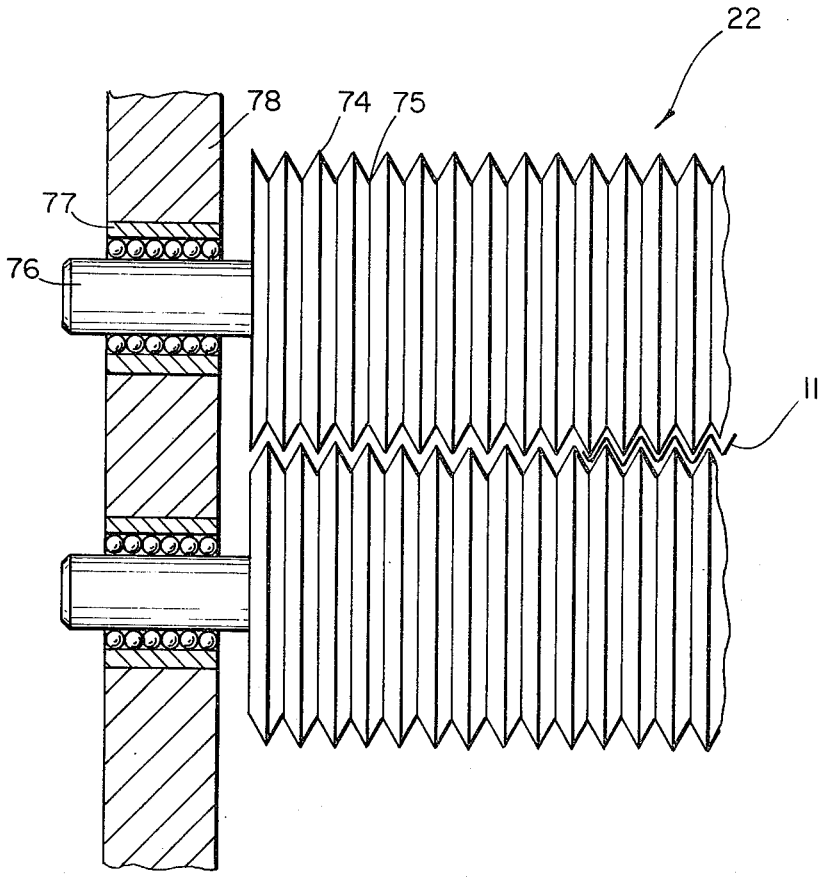
FIG. 9 is a partial, front, elevational view of a pair of crimping rollers useful with the present invention.

Also in the preferred embodiment there is provided a pair of crimping rollers 22 which provide additional corrugations in the paper. The crimping rollers are shown particularly in FIG. 9. The rollers include several ridges 74 and grooves 75 which provide comparable folds in the paper 11. The rollers are mounted on shafts 76 which are received in bearings 77 mounted to the support members 78. The support members 78 are attached to the sub-frame 26. Passage of the paper between the crimping rollers provides the additional corrugations more comparable to that associated with corrugated paper.

As thus described, the paper corrugator 19 is useful in the production of corrugated paper. It is a particular aspect of the present invention that the paper is passed over arcuate rollers 13 and 14, with folds being formed in the paper between the two rollers and along radial lines extending from the center of curvature for the rollers. The paper is thereafter unfolded, and preferably is crimped to provide additional corrugations. It is a particular aspect of the present invention that the paper is thereby reduced in width from the initial sheet width to a reduced width corresponding with the width of the ultimate corrugated paper. This width reduction is accomplished along radial lines to permit all portions of the paper to move about the same distance in the area in which the folds are created.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for the production of corrugated paper which comprises the steps of:

a. feeding a continuous sheet of paper over a first elongated arcuate roller, said first arcuate roller being arcuately curved along its length and disposed in a first plane, said paper being fed to said first arcuate roller at an angle of about 90° to said first plane and said paper passing from said first arcuate roller in a path approximately along said first plane;

b. moving the paper along in said first plane to a second elongated arcuate roller also arcuately curved along its length while simultaneously making several longitudinal folds in said paper to reduce the overall width of said paper, said second arcuate roller being in said first plane, said first and second arcuate rollers having a common center of curvature about which they are curved, said longitudinal folds thereby extending radially between said first and second arcuate rollers;

c. feeding the folded paper over said second arcuate roller, said folded paper being fed to said second arcuate roller in said first plane and said folded paper passing from said second arcuate roller along a path at an angle of about 90° to said first plane; and d. opening the folds of the paper to yield a corrugated paper having several parallel ridges and grooves.

2. The method of claim 1 in which step b. includes passing said paper through a first set of folding members for making several parallel longitudinal ridges and grooves in said paper, said ridges and grooves being spaced apart by alternating first and second widths, said first width being greater than said second width, step b. further including passing said paper through a second set of folding members for longitudinally folding said ridges and first widths of said paper to overlay the adjacent second widths of the paper with each first width being received between said adjacent second widths.

3. The method of claim 1 and which further includes after step d. crimping said paper to form additional parallel ridges and grooves.

4. The method of claim 3 in which step b. includes passing said paper through a first set of folding members for making several parallel longitudinal ridges and grooves in said paper, said ridges and grooves being spaced apart by alternating first and second widths, said first width being greater than said second width, step b.

further including passing said paper through a second set of folding members for longitudinally folding said ridges and first widths of said paper to overlay the adjacent second widths of the paper with each first width being received between said adjacent second widths.

5. The method of claim 1 and which includes, after step c., passing said folded paper over a straight roller, said folded paper passing from said straight roller in a second plane parallel to said first plane.

6. The method of claim 5 and which further includes after step d. crimping said paper to form additional parallel ridges and grooves.

7. The method of claim 6 in which step b. includes passing said paper through a first set of folding members for making several parallel longitudinal ridges and grooves in the paper, said ridges and grooves being spaced apart by alternating first and second widths, said first width being greater than said second width, step b. further including passing said paper through a second set of folding members for longitudinally folding said ridges and first widths of said paper to overlay the adjacent second widths of said paper with each first width being received between said adjacent second widths.

* * * * *